US005336066A

United States Patent [19]

Myers et al.

[11] Patent Number: 5,336,066

[45] Date of Patent: Aug. 9, 1994

[54] BALLOON PUMP

[75] Inventors: Thomas M. Myers, 1509 Parker Bend, Austin, Tex. 78734; James R. Mensing, Austin, Tex.

[73] Assignee: Thomas M. Myers, Austin, Tex.

[21] Appl. No.: 984,985

[22] Filed: Dec. 2, 1992

[51] Int. Cl.[5] ..... F04B 39/10

[52] U.S. Cl. ..... 417/555.1; 417/234; 446/220; 92/13.41

[58] Field of Search ..... 417/555.1, 567, 559, 417/234; 446/180, 220, 222, 225; 92/130 B, 132, 13.41; 124/56, 63, 65, 68

[56] References Cited

U.S. PATENT DOCUMENTS

| | | | |
|---|---|---|---|
| D. 185,587 | 6/1959 | Van Dam . | |
| D. 220,840 | 6/1971 | Rolsten . | |
| D. 322,471 | 12/1991 | Myers . | |
| 634,961 | 10/1899 | Smith | 92/132 |
| 1,473,968 | 11/1923 | Nevill | 92/13.41 |
| 1,689,636 | 10/1928 | Milder | 92/13.41 |
| 2,539,846 | 1/1945 | Lewis et al. | 417/555.1 |
| 3,224,378 | 12/1965 | Graham | 417/511 |
| 3,232,182 | 2/1966 | Gilbert | 92/13.41 |
| 3,286,392 | 11/1966 | Fortunato | 446/225 |
| 4,679,989 | 7/1987 | Harriman et al. | 92/13.41 |
| 5,026,261 | 6/1991 | Jou | 417/555.1 |

FOREIGN PATENT DOCUMENTS

| | | | |
|---|---|---|---|
| 523682 | 4/1931 | Fed. Rep. of Germany | 417/559 |
| 1275037 | 9/1961 | France | 124/65 |

*Primary Examiner*—Richard A. Bertsch
*Assistant Examiner*—Roland G. McAndrews, Jr.
*Attorney, Agent, or Firm*—Shafer & Culbertson

[57] ABSTRACT

A balloon pump includes a cylinder having an outlet end and a piston adapted to reciprocate within the cylinder. One-way outlet and inlet valves are associated with the pump for allowing air to exit the cylinder outlet end only when the piston moves toward the outlet end and enter the cylinder only when the piston reciprocates away from the cylinder outlet end. An elongated piston drive member or base is connected at one end to the piston with the other end extending out of the cylinder at the end opposite the cylinder outlet end. A biasing arrangement acts between the cylinder and the piston to bias the piston away from the outlet end of the cylinder. With the pump positioned vertically and supported on the elongated piston drive member, the biasing arrangement raises the cylinder to perform a return stroke so that the pump may be operated simply by pushing down on the cylinder.

2 Claims, 2 Drawing Sheets

BALLOON PUMP

BACKGROUND OF THE INVENTION

This invention relates to pumps for inflating balloons and particularly to a balloon pump designed for use by performers who make balloon figures and articles.

Magicians and other performers often use balloons in their acts to create balloon articles and figures. Usually the performer works alone and must inflate the balloons himself during the show. Although a balloon can be inflated by exhalation, this method prevents the performer from speaking and thus interrupts the performance. Also blowing up balloons in this manner is exhausting. Therefore, hand and motor operated pumps and compressed gas cylinders have also been used for inflating balloons during a performance. Motor driven pumps, however, are too noisy and interfere with the performance, while compressed gas cylinders are too bulky and expensive, particularly for street performers. Therefore, hand operated pumps are most popular with performers.

U.S. Pat. No. D. 220,840 shows one ornamental design for a pump suitable for inflating balloons. This design patent discloses a piston and cylinder type pump with a handle and rod for driving the pump piston and a handle on an outlet end of a cylinder. This pump, however, requires two hands to operate and is thus cumbersome to use in a performance.

U.S. Pat. No. D. 322,471 to the current inventor shows a balloon pump designed specifically for use by performers. This pump includes an elongated piston connected to a base so as to stand upright. A cylinder fits over the piston and is adapted to be moved up and down over the stationary piston by the performer to produce the pump stroke. Although the pump shown in this design patent is lightweight and easily transportable and leaves the performer free to speak while inflating balloons, it still requires two hands to operate. That is, the cylinder must be lifted up by the ring at the top of the cylinder with two hands and then pushed down with one hand to inflate the balloon. Also, the pump shown in the '471 design patent has a fixed height and is uncomfortable for performers above and below a certain height range.

SUMMARY OF THE INVENTION

It is a general object of the invention to provide a hand operated balloon pump that overcomes the above described problems and others associated with balloon pumps particularly for use by performers.

To accomplish this object, a balloon pump according to the invention comprises a piston and cylinder with the piston position controlled by a drive member or base whose length can be easily varied to suit the particular user. The current balloon pump also includes a biasing mechanism. The biasing mechanism biases the piston and piston drive member to which it is attached away from the outlet end of the cylinder. The pump therefore may be supported vertically on the base or piston drive member and the biasing means acts to automatically raise the cylinder to a position in which it may be pushed down with one hand to perform the pump stroke. After the pump stroke, the biasing means raises the cylinder again to the position for another pump stroke. The only force applied by the operator to operate the pump is a pushing force that may be applied with one hand at the top of the cylinder. The pump stroke may be performed with one hand pushing on the cylinder while simultaneously holding a balloon on a nozzle at the outlet end of the cylinder.

The piston drive member or base comprises an elongated member connected at one end to the piston. The other end of the piston drive member extends out of the cylinder at the end opposite the cylinder outlet end. Preferably the base or piston drive member comprises a wooden rod or plastic tube. The rod or tube has a length adapted to position the top or outlet end of the cylinder at a height to suit the particular performer.

The biasing means comprises an elongated piece of resilient material connected to act between the piston and cylinder. The resilient material is adapted to elongate elastically when the piston is moved to the outlet end of the cylinder by pushing the cylinder down over the piston drive member or base. The elongated resilient material, therefore, provides a force adapted to pull the piston away from the cylinder outlet end. Preferably the piston drive member or base exits the cylinder through a drive member guide mounted at the end of the cylinder opposite the outlet end and the length of elastic material is connected at both ends to the guide member and extends upwardly through an opening through the base or drive member near the piston.

These and other objects, advantages, and features of the invention will be apparent from the following description of the preferred embodiments, considered along with the accompanying drawings.

DESCRIPTION OF THE PREFERRED EMBODIMENTS

Figure 1:
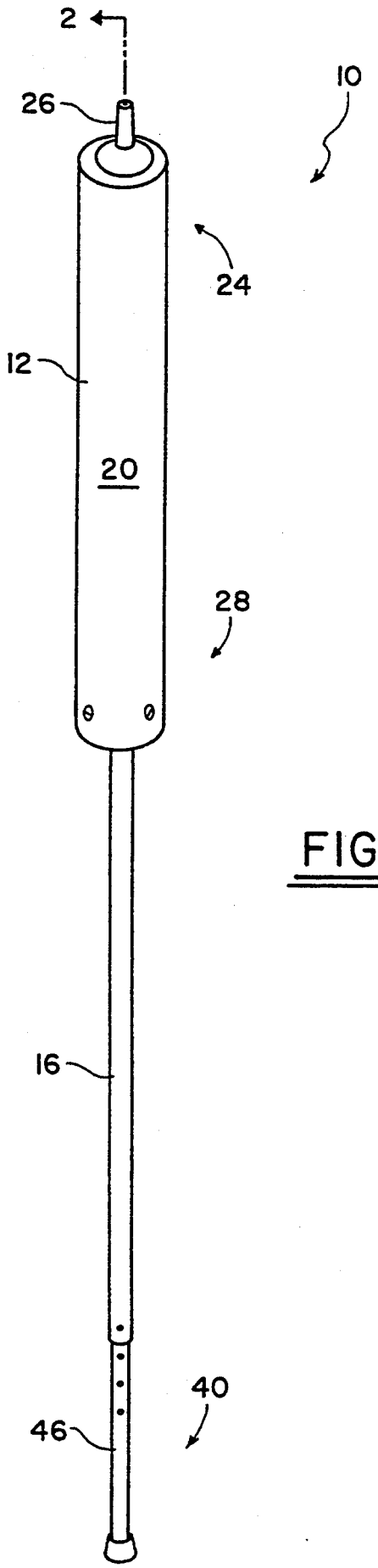
FIG. 1 is a view in perspective of a balloon pump embodying the principles of the invention.
Figure 2:
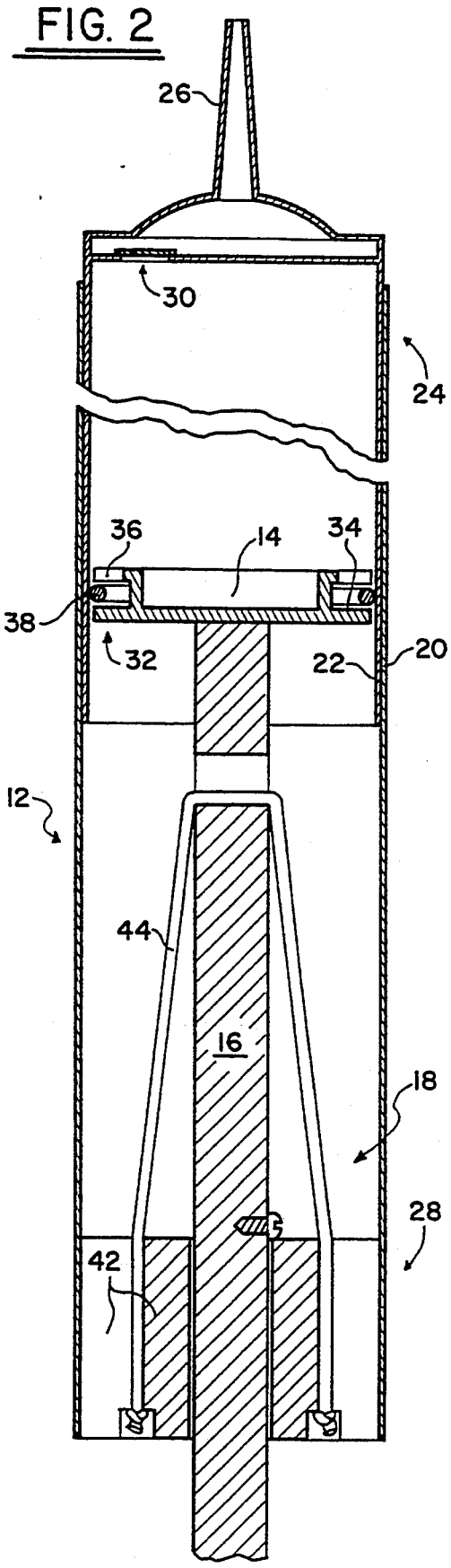
FIG. 2 is a view in longitudinal section taken along line 2—2 in FIG. 1.
Figure 3:
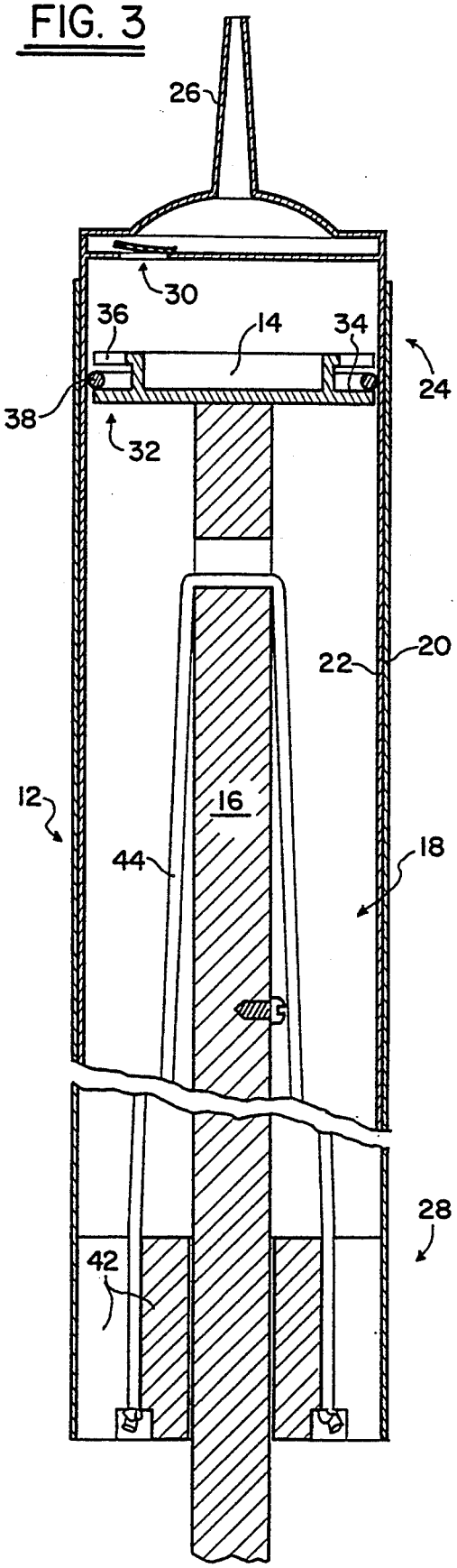
FIG. 3 is a view in longitudinal section similar with FIG. 2 but with the cylinder pressed downwardly with respect to the piston and piston drive member.

FIGS. 1 through 3 show a balloon pump 10 embodying the principles of the invention. The pump 10 is a positive displacement-type pump and includes an elongated cylinder 12 and a piston 14 adapted to reciprocate therein. The piston 14 may be driven within the cylinder 12 by an elongated piston drive member 16 and is biased by biasing means generally indicated at reference numeral 18.

The illustrated preferred cylinder 12 is a two piece design with an outer housing 20 and in inner sleeve 22. The outer housing 20 may be a suitable lightweight material such as cardboard and the sleeve 22 is preferably made of a smooth wear-resistant plastic. Whether a one-piece or two-piece design, the cylinder 12 includes an outlet end 24 with a nozzle 26 through which air is expelled from the cylinder, and a second end 28.

The pump 10 also includes a one-way outlet valve 30 positioned at the outlet end 24 of the cylinder 12, leading from the cylinder to the nozzle 26. The outlet valve 30 allows air to exit the cylinder 12 as the piston 14 moves through a pump stroke toward the cylinder outlet end 24, but closes to prevent air from flowing in the opposite direction. Although any number of one-way valve arrangements may be used according to the invention, the illustrated form of the invention includes a flap-type outlet valve.

An inlet valve 32 associated with the pump 10 allows air to enter the cylinder 12 as the piston 14 moves through a return or inlet stroke away from the cylinder outlet end 24 and toward the cylinder second end 28. In the illustrated form of the invention the inlet valve 32 is associated with the piston 14 and comprises an o-ring groove 34 and bypass openings 36 built into the piston on its upper side. In operation, as the piston 14 travels through the pump stroke toward the cylinder outlet end 24, an o-ring 38 in the o-ring groove 34 is forced against the bottom edge of the groove and forms a seal between the piston and cylinder 12 allowing the piston to force air through the outlet valve 30. However, when the piston 14 travels through the return or inlet stroke, the o-ring 38 rides against the upper edge of the groove 34 adjacent to the bypass openings 36. The loose fit of the piston 14 within the cylinder 12 and the bypass openings 36 prevent a substantial seal between the piston and cylinder as the piston travels through the return or inlet stroke and allow air to bypass the piston and enter the cylinder.

The piston drive or base member 16 is connected at one end to the piston 14. The opposite or support end 40 of the drive member 16 extends out of the second end 28 of the cylinder 12. As discussed more fully below, the piston drive member 16 is preferably substantially longer than the cylinder 12, and in some forms of the invention as much as twice as long. Also, a guide member 42 is mounted at the cylinder second end 28 and functions as a guide for the piston drive member 16 as it moves in relation to the cylinder 12. The guide member 42 cooperates with the drive member connection to the piston 14 to center the drive member 16 within the cylinder 12.

As shown in FIGS. 2 and 3, the biasing 18 means comprises a length of resilient material 44 acting between the piston 14 and cylinder 12. In the preferred form of the invention, the length of elastic material 44 extends through an opening 46 in the drive member 16 near the piston 14 and is connected at both ends to the guide member 42. The length of elastic material 44 has sufficient elastic strength so that when the pump is placed in a vertical position and supported on the support end 40 of the drive member 16, the material acts to raise the cylinder 12 upwardly with respect to the piston 14. That is, the biasing means performs the return or inlet stroke, and biases the piston to the position shown in FIG. 2.

Alternatively, to the illustrated biasing means 18 comprising the elastic material arrangement, the biasing means may comprise any other suitable biasing arrangement. For example, the biasing means may comprise a suitable spring acting between the piston 14 or drive member 16 and the cylinder 12, or even a weight and pulley arrangement adapted to apply a sufficient force to raise the cylinder 12 with respect to the piston 14. Also, if an elastic biasing material is used in the biasing means, the elastic material may be connected in any way to act between the piston 14 or drive member 16 and the cylinder 12, and allow the desired range of motion between the piston and cylinder.

In operation, the pump 10, being preferably made from lightweight material, may be held vertically and supported primarily on the support end 40 of the piston drive member 16 as shown in the figures. The biasing means 18 biases the cylinder 12 upwardly with respect to the piston 14 and piston drive member 16 to the position shown in FIGS. 1 and 2. Starting from the position shown in FIG. 2, the operator or performer performs a pump stroke simply by applying sufficient force to the top of the cylinder 12 to push the cylinder downwardly with respect to the piston 14 and piston drive member 16 against the biasing force provided by the elastic member 44. As the cylinder 12 travels downwardly, the stationary piston 14 moves relatively toward the cylinder outlet end 24 to force air out of the outlet valve 30 and nozzle 26. At the end of the pump stroke, the operator or performer simply releases the force from the top of the cylinder and allows the biasing force to again push the cylinder 12 upwardly, returning the pump to the position shown in FIG. 2.

The balloon pump according to the invention has a number of benefits and advantages over prior balloon pumps. First, the height of the nozzle 26 can be adjusted easily by changing the overall length of the piston drive member 16. In one form of the invention the piston drive member may be made from a wooden rod or dowel or a plastic tube which can be easily cut to position the pump nozzle 26 at a desired operating height. In other forms of the invention, such as the form shown in FIG. 1, the piston drive member can be made of a plastic tube with a telescoping piece 48 near the base end 40. This telescoping arrangement allows the overall length of the piston drive member 16 to be varied to suit the particular user.

Another important advantage is that the pump 10 may be operated to inflate a balloon easily with one hand. The operator or performer can simply position the balloon to be inflated (not shown) on the nozzle 26 and, while holding the balloon on the nozzle, apply the required downward force with the same hand to perform the pump stroke. Furthermore, the pump is lightweight and compact and therefore easily transportable and inexpensive, and operates quietly to avoid interference with the performance. In fact the manual operation of the pump can be incorporated into the performance.

The above described preferred embodiments are intended to illustrate the principles of the invention, but not to limit the scope of the invention. Various other embodiments and modifications to these preferred embodiments may be made by those skilled in the art without departing from the scope of the following claims. For example, the various parts of the pump 10 can be made of any suitable material. Also, the one-way inlet and outlet valves may be any type of valve arrangement suited for the one-way inlet or outlet functions, respectively.

I claim:

1. A balloon pump comprising:

(a) an elongated cylinder having an outlet end and a second end;

(b) a piston adapted to reciprocate within the cylinder, moving toward the cylinder outlet end during a pump stroke and in the opposite direction toward the cylinder second end during a return stroke;

(c) an elongated piston drive member connected at one end to the piston so that a base end opposite the end connected to the piston extends out of the cylinder through the cylinder second end, the piston drive member having a length sufficient for the base end to extend out of the cylinder second end when the piston is located at any point along the pump stroke;

(d) a drive member guide connected to the cylinder at the second end thereof and through which the piston drive member extends out of the cylinder second end;

(e) a one-way outlet valve mounted at the cylinder outlet end for allowing air from the cylinder to exit the cylinder therethrough during the pump stroke and for preventing air from entering the cylinder therethrough during the return stroke;

(f) a one-way inlet valve for allowing air to enter the cylinder therethrough during the return stroke and for preventing air from exiting the cylinder therethrough during the pump stroke; and (g) a length of resilient material extending through a transverse opening through the piston drive member at a location near the piston and connected at both ends to the drive member guide, the resilient material for continuously biasing the piston toward the cylinder second end with sufficient force to perform the return stroke by raising the cylinder with respect to the piston drive member when the pump is positioned simultaneously vertically and is supported on the base end of the piston drive member.

2. In a balloon pump of the type having a piston that reciprocates within an elongated cylinder driven by a piston drive member connected at one end to the piston with the other end extending out of the cylinder at an end of the cylinder opposite an outlet end thereof, the improvement comprising:

(a) a drive member guide connected to the cylinder at the end opposite the outlet end thereof and through which the piston drive member extends out of the cylinder; and (b) a length of resilient material extending through a transverse opening through the piston drive member near the piston and connected at both ends to the drive member guide, the resilient material for biasing the piston in the direction toward the end of the cylinder opposite the outlet end thereof with sufficient force to raise the cylinder with respect to the piston drive member when the pump is positioned substantially vertically and supported on the piston drive member.

* * * * *

UNITED STATES PATENT AND TRADEMARK OFFICE

CERTIFICATE OF CORRECTION

PATENT NO. : 5,336,066

DATED : August 9, 1994

INVENTOR(S) : Thomas M. Myers and James R. Mensing

It is certified that error appears in the above-identified patent and that said Letters Patent is hereby corrected as shown below:

In column 5, line 23 of the Patent, change the word "simultaneously" to —substantially--.

Signed and Sealed this

Eleventh Day of October, 1994

*Attest:*

*Attesting Officer*

Bruce Lehman

BRUCE LEHMAN

*Commissioner of Patents and Trademarks*